US008110090B2

(12) United States Patent
Zimmerman et al.

(10) Patent No.: US 8,110,090 B2
(45) Date of Patent: Feb. 7, 2012

(54) DEASPHALTING OF GAS OIL FROM SLURRY HYDROCRACKING

(75) Inventors: Paul R. Zimmerman, Palatine, IL (US); Mark Van Wees, Des Plaines, IL (US); Robert S. Haizmann, Rolling Meadows, IL (US); Milan Skripek, Murrieta, CA (US)

(73) Assignee: UOP LLC, Des Plaines, IL (US)

( * ) Notice: Subject to any disclaimer, the term of this patent is extended or adjusted under 35 U.S.C. 154(b) by 359 days.

(21) Appl. No.: 12/410,817

(22) Filed: Mar. 25, 2009

(65) Prior Publication Data

US 2010/0243518 A1 Sep. 30, 2010

(51) Int. Cl.
*C10C 3/08* (2006.01)

(52) U.S. Cl. ..... 208/45

(58) Field of Classification Search ..... 208/45
See application file for complete search history.

(56) References Cited

U.S. PATENT DOCUMENTS

| | | | | |
|---|---|---|---|---|
| 3,161,585 | A * | 12/1964 | Gleim et al. | 208/264 |
| 3,168,459 | A * | 2/1965 | Anderson et al. | 208/57 |
| 3,775,292 | A | 11/1973 | Watkins | |
| 3,775,293 | A | 11/1973 | Watkins | |
| 4,169,038 | A | 9/1979 | Metrailer et al. | 208/20 |
| 4,178,227 | A | 12/1979 | Metrailer et al. | 208/50 |
| 4,204,943 | A | 5/1980 | Metrailer et al. | 208/50 |
| 4,354,922 | A | 10/1982 | Derbyshire et al. | 208/68 |
| 4,358,365 | A | 11/1982 | Hutchings et al. | |
| 4,364,819 | A | 12/1982 | Hutchings et al. | 208/96 |
| 4,525,267 | A * | 6/1985 | Inooka | 208/58 |
| 4,569,751 | A | 2/1986 | Eidt, Jr. et al. | 208/53 |
| 4,569,752 | A | 2/1986 | Aldridge et al. | 208/54 |
| 4,591,426 | A | 5/1986 | Krasuk et al. | 208/96 |
| 4,640,762 | A | 2/1987 | Woods et al. | |
| 4,698,146 | A * | 10/1987 | Gruia | 208/86 |
| 4,750,985 | A | 6/1988 | Aldridge et al. | 208/53 |
| 4,882,036 | A | 11/1989 | Eidt, Jr. et al. | 208/50 |
| 4,954,240 | A | 9/1990 | Eidt, Jr. et al. | 208/50 |
| 5,755,955 | A | 5/1998 | Benham et al. | 208/112 |
| 5,985,132 | A | 11/1999 | Hoehn et al. | |
| 6,004,453 | A | 12/1999 | Benham et al. | 208/108 |
| 6,171,471 | B1 | 1/2001 | Ferrughelli et al. | 208/6 |
| 6,511,937 | B1 | 1/2003 | Bearden, Jr. et al. | 502/180 |
| 6,517,706 | B1 | 2/2003 | Pruden et al. | 208/108 |
| 7,341,657 | B2 * | 3/2008 | Li et al. | 208/89 |
| 7,390,398 | B2 | 6/2008 | Farshid et al. | 208/413 |
| 2002/0005374 | A1 | 1/2002 | Roby, Jr. et al. | 208/86 |
| 2006/0054533 | A1 | 3/2006 | Chen et al. | |
| 2006/0118463 | A1 | 6/2006 | Colyar et al. | |
| 2006/0157385 | A1 | 7/2006 | Montanari et al. | |
| 2006/0175229 | A1 * | 8/2006 | Montanari et al. | 208/49 |
| 2007/0138056 | A1 | 6/2007 | Farshid et al. | 208/49 |
| 2007/0138057 | A1 | 6/2007 | Farshid et al. | |
| 2007/0138058 | A1 | 6/2007 | Farshid et al. | 208/57 |
| 2007/0138059 | A1 | 6/2007 | Farshid et al. | |
| 2007/0140927 | A1 | 6/2007 | Reynolds | 422/140 |
| 2007/0144944 | A1 | 6/2007 | Del Bianco et al. | 208/435 |
| 2008/0156693 | A1 | 7/2008 | Okui et al. | |
| 2008/0210597 | A1 * | 9/2008 | Yoo et al. | 208/41 |

FOREIGN PATENT DOCUMENTS

| | | |
|---|---|---|
| GB | 2167430 | 5/1986 |
| WO | 2004056946 A2 | 7/2004 |

OTHER PUBLICATIONS

J. Zhou, High Conversion Slurry Bed Hydrocracking Process for Producing High Octane Gasoline and High Cetane Diesel Simultaneously from Vacuum Gas Oil, 48 Prepr. Pap.-Am. Chem. Soc., Div. Fuel Chem. 668-669 (2003).*

S. Zhang et al., A Review of Slurry-Phase Hydrocracking Heavy Oil Technology, 21 Energy Fuels 3057-3062 (2007).*

Montanari, "Production of ULS Fuels from Heavy Feedstocks" Petroleum Technology Quarterly 8(1) 2003 p. 61-62 64 66-67.

Montanari, "Upgrading Petroleum Residues with EST Process", Eni Tecnologie, Italy, 2003 World Petroleum Congress, p. 331-338.

Kato, K, "Novel combination process of heavy oil cracking using disposable additive catalyst," Hungarian Chemical Society, "Additives in Petroleum Refinery and Petroleum Product [and lubricants] Formulation Practice, Additives '97" Conference (Sopron May 21-23, 1997) Proceedings 4-7 (1997).

Kato, K, "Novel combination process of heavy oil cracking using disposable additive catalyst," Hungarian Chemical Society, "Additives in Petroleum Refinery and Petroleum Product [and lubricants] Formulation Practice, Additives '97" Conference (Sopron May 21-23, 1997) Proceedings 4-7 (1997) [Abstract Only].

Poole, M. C. et al., "MICROCAT-RC(TM) upgrading option for heavy crudes and residue," AIChE 1994 Spring National Meeting (Atlanta Apr. 17-21, 1994) Preprint N. 56d 14P.

Schulman, B. L. et al., "Advances in technologies for residue upgrading" Natl. Pet. Refiners Assoc. Annual Meeting (San Francisco Mar. 19-21, 1989) Pap. N.AM-89-18 10P.

(Continued)

*Primary Examiner* — Jill Warden
*Assistant Examiner* — Randy Boyer
(74) *Attorney, Agent, or Firm* — James C. Paschall

(57) ABSTRACT

Integrated slurry hydrocracking (SHC) and solvent deasphalting (SDA) methods for making slurry hydrocracking (SHC) distillates are disclosed. Representative methods involve passing a slurry comprising a vacuum column resid, a recycled, deasphalted oil obtained from SDA, and a solid particulate through an SHC reaction zone in the presence of hydrogen to obtain the SHC distillate. Fractionation or distillation in the SHC product recovery section yields a combined SHC gas oil/SHC pitch stream that is sent to SDA. In a representative embodiment, vacuum distillation in the SHC product recovery is avoided, thereby eliminating equipment that is often most susceptible to fouling.

19 Claims, 1 Drawing Sheet

OTHER PUBLICATIONS

Yu, D. et al., "Coking properties of slurry-bed hydrocracked residue," ACS Division of Petroleum Chemistry, Inc. Preprints 46(3) 2001 p. 264-266, ACS 222nd National Meeting, 2001, Chicago, IL ISSN: 05693799.

Haizmann, Robert S. et al. "Integrated slurry hydrocracking and coking process" pending U.S. Appl. No. 12/271,851, filed Nov. 15, 2008.

Bauer, Lorenz J. et al. "Improved solids management in slurry hydroprocessing", pending U.S. Appl. No. 12/271,857, filed Nov. 15, 2008.

Haizmann, Robert S. et al. "Integrated solvent deasphalting and slurry hydrocracking process", pending U.S. Appl. No. 12/271,861, filed Nov. 15, 2008.

Nagamatsu et al., "Present and future heavy oil upgrading technology in petroleum refining," *Nihon Enerugi Gakkaishi/Journal* of the Japan Institute of Energy, v 85, n 4, Apr. 2006, p. 271-276, Language: Japanese. [Abstract only].

Dickenson et al., "Refiner options for converting and utilizing heavy fuel oil," *Hydrocarbon Processing*, v 76, n 2, Feb. 1997, 5 pp.

De Drago et al., "Development of HDH process, a refiner's tool for residual upgrading,"*Preprints—Division of Petroleum Chemistry*, American Chemical Society, v 35, n 4, Aug. 1990, p. 584-592.

Montanari et al., "Upgrading petroleum residues with EST process," *Eni Tecnologie*, Italy, 2003 World Petroleum Congress, p. 331-338.

Zimmerman et al., "Coking of gas oil from slurry hydrocracking," pending U.S. Appl. No. 12/271,880, filed Nov. 15, 2008.

* cited by examiner

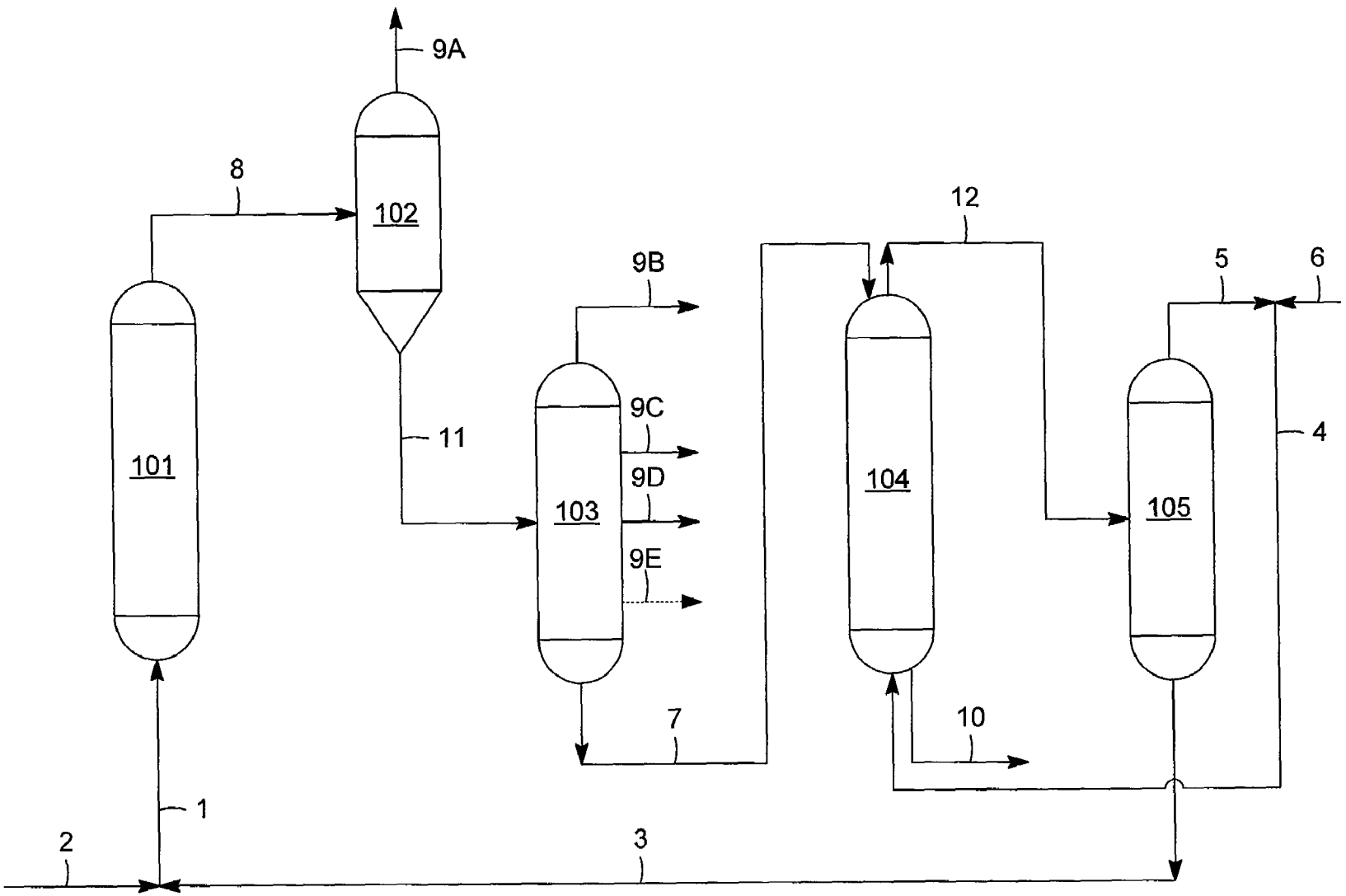
101
102
103
104
105
1
2
3
4
5
6
7
8
9A
9B
9C
9D
9E
10
11
12

DEASPHALTING OF GAS OIL FROM SLURRY HYDROCRACKING

FIELD OF THE INVENTION

The present invention relates to methods for preparing distillate hydrocarbons using slurry hydrocracking (SHC). The heavy hydrocarbon feedstock to SHC comprises a deasphalted oil (DAO), obtained from subjecting an SHC gas oil (e.g., a liquid bottoms product of an SHC atmospheric distillation column, also comprising an SHC pitch) to solvent deasphalting (SDA).

DESCRIPTION OF RELATED ART

Solvent deasphalting (SDA) generally refers to refinery processes that upgrade hydrocarbon fractions using extraction in the presence of a solvent. The hydrocarbon fractions are often obtained from the distillation of crude oil, and include hydrocarbon residues (or resids) or gas oils from atmospheric column or vacuum column distillation. Solvents used in SDA are typically lower-boiling paraffinic hydrocarbons such as propane, butanes, pentanes and their mixtures, having the ability to extract a deasphalted oil (DAO) with relatively lower levels of contaminants such as sulfur- and nitrogen-containing compounds, metals, and Conradson carbon residue. The extraction usually occurs in a countercurrent extractor, with the solvent phase and its extracted components flowing in an upward direction. In addition to DAO, the other major product of SDA is pitch, a highly viscous hydrocarbon that contains significant portions of the (non-extracted) contaminants present in crude oil.

The yields and quality of both the DAO and SDA pitch depend on the composition of the SDA feed, the type and amount of solvent, and the extraction conditions. The DAO produced from SDA is a generally nondistillable product requiring further upgrading with fluid catalytic cracking (FCC), hydrocracking, and/or hydrotreating. Additionally, the significant quantities of pitch from SDA make this process less economically attractive compared to alternative heavy oil conversion processes.

In addition to DAO, further refinery process streams normally sent to conventional conversion processes such as FCC, in order to yield more salable products, include gas oils and particularly vacuum gas oil (VGO). Gas oils are produced in a number of refinery operations, including slurry hydrocracking, coking, crude oil fractionation, and visbreaking, which process heavy hydrocarbon feedstocks. Because of their significant levels of contaminants (e.g., metals and sulfur compounds) that deactivate supported metal catalysts, in addition to coke precursors in these streams, gas oils are unfortunately not easily processed according to conventional catalytic conversion methods. The conversion of gas oils to more valuable distillate and naphtha blending components for transportation fuels is therefore associated with a number of drawbacks.

Like SDA, slurry hydrocracking (SHC) is also used for the upgrading of heavy hydrocarbon feedstocks including those mentioned above. In SHC, these feedstocks are converted in the presence of hydrogen and solid catalyst particles (e.g., as a particulate metallic compound such as a metal sulfide) in a slurry phase. Representative slurry hydrocracking processes are described, for example, in U.S. Pat. No. 5,755,955 and U.S. Pat. No. 5,474,977. In addition to the gas oil (e.g., VGO) normally present in the reactor effluent, SHC (like SDA) produces a low-value, refractory pitch stream that normally cannot be economically upgraded or even blended into other products such as fuel oil or synthetic crude oil, due to its high viscosity and solids content.

Attempts to reduce the yield of low-value SHC pitch have focused on increasing the per-pass conversion of the heavy hydrocarbon feedstock, in the SHC reactor, to distillate hydrocarbons boiling below a typical cutoff temperature, for example an initial boiling point temperature of a crude oil atmospheric column resid, which is often about 343° C. (650° F.). However, high conversion levels in SHC are obtained at the expense of a greater risk of precipitating asphaltenes present in the heavy hydrocarbon feedstock, into mesophase and coke. This generally results in an SHC operation requiring a larger quantity of additives such as polar hydrocarbons (e.g., aromatics) to improve the asphaltene solubilizing capability of the SHC reaction mixture. Moreover, higher SHC conversion levels to reduce pitch yields also decrease the selectivity to desired products, due to secondary cracking reactions that generate light gases. In addition to the increased tendency for asphaltene precipitation and reduced product yields, hydrogen consumption increases rapidly as SHC reactor conversion exceeds about 90%, also as a result of secondary cracking, in combination with the added hydrogen consumption by the most refractory and hydrogen deficient components of the heavy hydrocarbon feedstock.

There is an ongoing need in the art for process in which heavy hydrocarbons (e.g., atmospheric column and vacuum column resids as well as gas oils) are converted or upgraded with improved efficiency. There is also a need for such processes in which the yields of (i.e., conversion to, and selectivity for) the most valuable upgraded products are maximized while maintaining a stable operating regime and a judicious consumption of both hydrogen and asphaltene precipitation-inhibiting additives. There is further a need for overall crude oil refining processes that include the upgrading of crude oil residues and particularly those obtained in significant proportions from heavy crude oil feedstocks. Ideally, the products of such refining processes should be suitable as transportation fuel (e.g., diesel and/or naphtha) blending components or even for blending into synthetic crude oils to improve their properties (e.g., viscosity and/or specific gravity).

SUMMARY OF THE INVENTION

Aspects of the invention relate to the finding that slurry hydrocracking (SHC) can be effectively integrated with solvent deasphalting (SDA), and optionally hydrotreating, and/or crude oil fractionation to produce one or more high value distillate streams. SHC is generally known in the art for its ability to convert vacuum column residues to lighter products. It has now been discovered that subjecting the heavy liquid products from SHC and particularly SHC gas oils and SHC pitch to SDA provides a number of important advantages.

For example, the use of SDA allows for the concentration and removal of detrimental asphaltenes, in the SDA pitch, from the combined heavy hydrocarbon feedstock to SHC. This feedstock includes all or at least a portion (i.e., a recycled portion) of a deasphalted oil (DAO) obtained from SDA. Recycling of the DAO obtained from SHC back to the SHC reaction zone effectively converts this feedstock component to valuable distillate products, despite the low value of this stream and difficultly in converting it using other upgrading methods. The integration of SHC with SDA therefore beneficially allows recycled DAO to be upgraded, for example, to VGO, distillate hydrocarbons, and naphtha. Moreover, the DAO obtained from SDA may also contain a significant amount of polar aromatic compounds (both mono-ring and multi-ring) that beneficially act as solvents of asphaltenes. Recycle of this DAO back to the SHC reactor, as a component of the heavy hydrocarbon feedstock, therefore advantageously stabilizes asphaltenes in the SHC reactor or reaction zone and throughout the process to reduce the tendency for asphaltene precipitation and equipment fouling.

This integration of SHC and SDA as described herein allows a reduced per-pass conversion in the SHC reaction zone and consequently improved yields of desired distillate hydrocarbon products in an operating regime that avoids significant secondary, non-selective cracking reactions. The reduced per-pass conversion and corresponding yield improvement will normally also accompany a decreased consumption of make-up hydrogen and additives required to maintain asphaltene solubility. The hydrogen and additive requirements are further relaxed in view of the removal, from the SHC reaction zone, of pitch containing high concentrations of both hydrogen-deficient compounds and asphaltenes. A representative per-pass conversion of the heavy hydrocarbon feedstock to gas oil boiling range hydrocarbons and lighter hydrocarbons (i.e., hydrocarbons boiling at a temperature of less than 566° C. (1050° F.)) is therefore less than about 90%, for example in the range from about 80% to about 90%. Also, a representative rate of hydrogen consumption in the SHC reaction zone is less than about 356 cubic meters per cubic meter ($m^3/m^3$) of heavy hydrocarbon feedstock (less than about 2000 standard cubic feet per barrel (SCFB) of hydrocarbon feedstock), for example in the range from about 178 $m^3/m^3$ to about 320 $m^3/m^3$ (about 1000 SCFB to about 1800 SCFB) or from about 214 to about $m^3/m^3$ to about 285 $m^3/m^3$ (about 1200 SCFB to about 1600 SCFB).

In an integrated SHC/SDA process, both SHC gas oil and an SHC pitch, which are obtained in the SHC reactor effluent, may be recovered together as liquid bottoms product of an SHC atmospheric distillation and passed to SDA. The SHC distillate is recovered as a lower boiling component of the SHC reactor effluent. According to some embodiments of the invention, therefore, the conventional separation of the higher boiling SHC reactor effluent components, namely the SHC gas oils from an SHC pitch, is avoided. This obviates the need for a vacuum distillation column and consequently its associated equipment (e.g., the vacuum column heater and reboiler), which are normally exposed to high temperature/heavy hydrocarbon service and are therefore highly susceptible to fouling. Like the combined SHC gas oil and SHC pitch, the SHC distillate may be recovered, in one or more distillate products, apart from (e.g., upstream of) the SDA process, such that the only component of the SHC reactor effluent that is passed to the SDA process is the combined SHC gas oil and SHC pitch. These SHC reactor effluent components, namely SHC distillate, SHC gas oil, and SHC pitch may all be recovered, according to a representative embodiment of the invention, in the absence of a vacuum distillation column.

The SHC gas oil and SHC pitch may therefore be recovered in combination, as a liquid bottoms product of either an SHC atmospheric distillation column or an SHC vacuum flash separator. In either case, a prior, upstream flash separation (e.g., using high pressure separator) of the total SHC reactor effluent (possibly after the removal of a recycle hydrogen stream) may be used to provide a liquid fraction as a feed to either the SHC atmospheric distillation column or the SHC vacuum flash separator. In the case of an SHC atmospheric distillation, having multiple stages of separation, one or more distilled fractions from this column, for example a naphtha product or a diesel product (or mixtures), may serve as distillate products of the total SHC distillate recovered. In the case of either an SHC atmospheric distillation column or an SHC vacuum flash separator, a vapor fraction obtained from upstream flash separation of the SHC effluent in an SHC high pressure separator, as discussed above, may further serve as a distillate product of the total SHC distillate recovered. Otherwise, it is possible to recover the heavy liquid products of SHC (e.g., SHC gas oil and SHC pitch), as a feed to SDA, in a total liquid fraction from flash separation of the SHC reactor or reaction zone effluent in an SHC high pressure separator. This additionally obviates the need for an atmospheric column, as well as a vacuum column.

In a representative integrated process, a crude oil vacuum column residue is utilized in combination with recycled DAO that is obtained from SDA, in the overall heavy hydrocarbon feedstock to SHC. Therefore, while a portion of this SHC feedstock is generally a conventional component (e.g., a vacuum column resid), the presence of a least a portion of the DAO, and preferably all DAO, generated via SDA downstream of the SHC reactor or reaction zone, improves the SHC reactor effluent quality, particularly with respect to a reduced fouling tendency and reduced coke yield (i.e., due to the stabilization of asphaltene coke precursors), as discussed above. Moreover, the DAO is often difficult to further upgrade using FCC, hydrocracking, or hydrotreating due to the high levels of contaminants that poison (deactivate) catalysts used in these processes.

Aspects of the invention are therefore associated with the discovery that recycle DAO is an attractive incremental feedstock (e.g., in combination with a vacuum column residue) which is efficiently cracked using SHC to yield lighter and more valuable net distillate and optionally naphtha products. Moreover, the integration of SHC with SDA offers the further advantage of upgrading, using SDA, the pitch byproduct of SHC, for example recovered in the bottoms product from an SHC atmospheric distillation in combination with SHC gas oil (e.g., SHC VGO). The overall decrease in gas oil end products, such as hydrocarbons boiling the VGO range, in the integrated SHC/SDA process, diminishes the need for the separate hydrotreating and/or hydrocracking of such products.

According to one representative embodiment, an integrated SHC/SDA process is combined with hydrotreating of the SHC distillate, or one or more of a number of distillate products that are components of the SHC distillate. As a result of the low (or non-existent) net yield of gas oil products such as VGO, according to some embodiments of the invention, the hydrotreated distillate, or components thereof, have a sufficiently high API gravity (e.g., at least about 20°), making them attractive for blending into a synthetic crude oil that is transported via a pipeline. Thus, components of the hydrotreated distillate, or even components of the SHC distillate without hydrotreating, may be obtained as one or a plurality of distillate products that are high quality transportation fuel blending component, with only a minor amount (e.g., less than about 20% by weight, or even less than about 10% by weight) or essentially no hydrocarbons boiling at a temperature representative of gas oils (e.g., greater than about 343° C. (650° F.)).

The SHC process may also be integrated with an existing refinery hydrotreating process, conventionally used for sulfur- and nitrogen-containing compound removal from distillates, by hydrotreating one or more recovered SHC distillate products in conjunction with a straight-run distillate obtained from crude oil fractionation and/or other refinery distillate streams. This integration may advantageously reduce overall capital costs of the complex. The integration of SHC with existing SDA, optionally hydrotreating, and optionally other conventional refinery operations therefore has the potential to provide significant benefits in terms of improved processing efficiency and product yields, reduction or elimination of low-value refractory byproducts, and/or the associated capital cost reduction. According to a specific embodiment of the invention, a crude oil vacuum column bottoms residue stream provides a part of the heavy hydrocarbon feedstock to an SHC reactor, and is combined at the inlet of the SHC reactor with all or a recycled portion of DAO from SDA. Other portions of the residue from the vacuum column or other fractions from this column, may also be passed to the SDA process itself. Regardless of the use of additional streams as feed to SDA, the DAO from this process or a recycled portion of this DAO can provide, together with a crude oil vacuum column bottoms residue and optionally a straight-run gas oil (e.g., straight-run VGO), the heavy hydrocarbon feedstock processed using SHC. An SHC pitch that is separated in combination with an SHC gas oil from the SHC effluent by fractionation may in turn be passed to SDA for upgrading, thereby resulting in integrated processes according to the present invention with the advantages discussed herein.

These and other aspects and embodiments relating to the present invention are apparent from the following Detailed Description.

BRIEF DESCRIPTION OF THE DRAWING

FIG. 1 depicts a representative process in which slurry hydrocracking is integrated with SDA to produce a SHC distillate comprising several distillate products.

DETAILED DESCRIPTION

Embodiments of the invention relate to the use of slurry hydrocracking (SHC) in combination with solvent deasphalting (SDA) to upgrade a heavy hydrocarbon feedstock. A representative heavy hydrocarbon feedstock to SHC comprises a deasphalted oil (DAO) that is obtained from subjecting an SHC gas oil to SDA. The DAO generally comprises aromatic compounds that beneficially solubilize asphaltenes, normally present in the heavy hydrocarbon feedstock, which would otherwise have a tendency to precipitate and lead to catalyst coking and equipment fouling. A representative liquid DAO product generally comprises at least about 10% (e.g., from about 20% to about 40%) by weight of aromatics.

Other components of the heavy hydrocarbon feedstock may include, as a fresh hydrocarbon feed, a refinery process stream conventionally converted using SHC. According to one embodiment, for example, the heavy hydrocarbon feedstock comprises both a vacuum column residue and the DAO product described above. Integration of an SDA process with SHC provides important benefits with a wide range of heavy hydrocarbon feedstocks, such that integrated processes may involve processing any of a number of heavy hydrocarbon feedstock components, in addition to all or a recycled portion of the DAO from SDA. These components benefit from the SHC operation to decrease the overall molecular weight of the heavy hydrocarbon feedstock, and/or remove organic sulfur and nitrogen compounds and metals. According to various embodiments, SHC is carried out in a regime such that the heavy hydrocarbon feedstock suppresses coke formation. Particular representative heavy hydrocarbon feedstocks comprise a significant portion of compounds boiling in a representative gas oil range (e.g., from about 343° C. (650° F.) to about 566° C. (1050° F.)) and normally comprise at most about 80% by weight, and often at most about 60% by weight, of compounds boiling above 566° C. (1050° F.).

In addition to all or a portion of DAO from SDA, representative further components of the heavy hydrocarbon feedstock include residual oils such as a crude oil vacuum distillation column residuum boiling above 566° C. (1050° F.), tars, bitumen, coal oils, and shale oils. Other asphaltene-containing materials such as whole or topped petroleum crude oils including heavy crude oils may also be used as components processed by SHC. In addition to asphaltenes, these further possible components of the heavy hydrocarbon feedstock, as well as others, generally also contain significant metallic contaminants (e.g., nickel, iron and vanadium), a high content of organic sulfur and nitrogen compounds, and a high Conradson carbon residue. The metals content of such components, for example, may be 100 ppm to 1,000 ppm by weight, the total sulfur content may range from 1% to 7% by weight, and the API gravity may range from about −5° to about 35°. The Conradson carbon residue of such components is generally at least about 5%, and is often from about 10% to about 30% by weight. Overall, many of the heavy hydrocarbon feedstock components of the SHC process, including the DAO, have properties that render them detrimental to other types of catalytic conversion processes such as hydrocracking and fluid catalytic cracking. It has been found that the integrated SHC/SDA processes described herein are particularly applicable for processing, as a fresh hydrocarbon component of the heavy hydrocarbon feed, residues (e.g., vacuum column resids) having a relatively low sulfur content, for example less than about 2% by weight, less than about 1% by weight, or even less than about 500 ppm by weight. Such low sulfur resids are often the most difficult to convert using SHC. Lighter hydrocarbon streams such as a crude oil atmospheric distillation column residuum boiling above about 343° C. (650° F.), may also be used components of the heavy hydrocarbon feedstock.

Integrated methods or processes for preparing SHC distillates generally involve passing a heavy hydrocarbon feedstock comprising the DAO through an SHC reaction zone in the presence of hydrogen to provide an SHC effluent. The heavy hydrocarbon feedstock may be, but is not necessarily, present in a heterogeneous slurry catalyst system in the SHC reactor, in which the catalyst is in the form of a solid particulate. For purposes of the present disclosure, however, homogeneous catalyst systems, in which the catalytically active metal is present in the liquid phase and is dissolved in the heavy hydrocarbon feedstock (e.g., as an oil-soluble metal compound such as a metal sulfide), also fall within the definition of an SHC process, since homogeneous processes are equally applicable for upgrading the same types of heavy hydrocarbon feedstocks with the same advantageous results associated with the embodiments discussed herein.

The SHC reaction may be carried out in the presence of a combined recycle gas containing hydrogen and under conditions sufficient to crack at least a portion of the heavy hydrocarbon feedstock to a lighter-boiling SHC distillate fraction that is recovered from the effluent of the SHC reactor. A representative combined recycle gas is a mixture of a hydrogen-rich gas stream, recovered from the SHC effluent (e.g., as an overhead gas stream from a high pressure separator) and fresh make-up hydrogen that is used to replace hydrogen consumed in the SHC reactor or reaction zone and lost in any purge or vent gas streams or through dissolution. Operation without hydrogen recycle (i.e., with "once-through" hydrogen) represents an alternative mode of operation, in which a number of possible hydrogen sources of varying purity may be used.

A slurry formed with the heavy hydrocarbon feedstock is normally passed upwardly through the SHC reaction zone, with the slurry generally having a solid particulate content in the range from about 0.01% to about 10% by weight. The solid particulate is generally a compound of a catalytically active metal, or a metal in elemental form, either alone or supported on a refractory material such as an inorganic metal oxide (e.g., alumina, silica, titania, zirconia, and mixtures thereof). Other suitable refractory materials include carbon, coal, and clays. Zeolites and non-zeolitic molecular sieves are also useful as solid supports. One advantage of using a support is its ability to act as a "coke getter" or adsorbent of asphaltene precursors that, as explained above, have a tendency to foul process equipment upon precipitation.

Catalytically active metals for use in SHC include those from Group IVB, Group VB, Group VIB, Group VIIB, or Group VIII of the Periodic Table, which are incorporated in the heavy hydrocarbon feedstock in amounts effective for catalyzing desired hydrotreating and/or hydrocracking reactions to provide, for example, lower boiling hydrocarbons that may be fractionated from the SHC effluent as naphtha and/or distillate products in the substantial absence of the solid particulate. Representative metals include iron, nickel, molybdenum, vanadium, tungsten, cobalt, ruthenium, and mixtures thereof. The catalytically active metal may be present as a solid particulate in elemental form or as an organic compound or an inorganic compound such as a sulfide (e.g., iron sulfide) or other ionic compound. Metal or metal compound nanoaggregates may also be used to form the solid particulates.

Often, it is desired to form such metal compounds, as solid particulates, in situ from a catalyst precursor such as a metal sulfate (e.g., iron sulfate monohydrate) that decomposes or reacts in the SHC reaction zone environment, or in a pretreatment step, to form a desired, well-dispersed and catalytically active solid particulate (e.g., as iron sulfide). Precursors also include oil-soluble organometallic compounds containing the catalytically active metal of interest that thermally decompose to form the solid particulate (e.g., iron sulfide) having catalytic activity. Such compounds are generally highly dispersible in the heavy hydrocarbon feedstock and normally convert under pretreatment or SHC reaction zone conditions to the solid particulate that is contained in the slurry effluent. An exemplary in situ solid particulate preparation, involving pretreating the heavy hydrocarbon feedstock and precursors of the ultimately desired metal compound, is described, for example, in U.S. Pat. No. 5,474,977.

Other suitable precursors include metal oxides that may be converted to catalytically active (or more catalytically active) compounds such as metal sulfides. In a particular embodiment, a metal oxide containing mineral may be used as a precursor of a solid particulate comprising the catalytically active metal (e.g., iron sulfide) on an inorganic refractory metal oxide support (e.g., alumina). Bauxite represents a particular precursor in which conversion of iron oxide crystals contained in this mineral provides an iron sulfide catalyst as a solid particulate, where the iron sulfide after conversion is supported on the alumina that is predominantly present in the bauxite precursor.

Conditions in the SHC reactor or reaction zone generally include a temperature from about 343° C. (650° F.) to about 538° C. (1000° F.), a pressure from about 3.5 MPa (500 psig) to about 21 MPa (3000 psig), and a space velocity from about 0.1 to about 30 volumes of heavy hydrocarbon feedstock per hour per volume of said SHC zone. The catalyst and conditions used in the SHC reaction zone are suitable for upgrading the heavy hydrocarbon feedstock to provide a lower boiling component, namely an SHC distillate fraction, in the SHC effluent exiting the SHC reaction zone.

The recovery of SHC distillate typically involves the use of flash separation and/or distillation of the SHC effluent, or a lower boiling fraction or cut thereof (e.g., a fraction having a lower distillation endpoint), to separate the SHC distillate as a lower boiling component, from the co-produced (or unconverted) SHC gas oil and SHC pitch, of the SHC effluent. The SHC distillate is generally recovered from the total SHC effluent (optionally after the removal of a hydrogen-rich gas stream for recycle to the SHC reactor, as discussed above) as a fraction having a distillation end point which is normally above that of naphtha. The SHC distillate, for example, may be recovered as one or more distillate products having a distillation end point temperature typically in the range from about 204° C. (400° F.) to about 399° C. (750° F.), and often from about 260° C. (500° F.) to about 343° C. (650° F), with heavier boiling compounds being separated into the liquid bottoms product of the SHC atmospheric distillation column, together with the SHC pitch that is used as a feedstock in downstream SDA.

According to a particular embodiment, the SHC distillate and a higher-boiling SHC fraction may be recovered as a high pressure separator (HPS) vapor fraction and an HPS liquid fraction, respectively, exiting a hot high pressure separator to which the SHC effluent is fed (optionally after the removal of the hydrogen-rich gas stream). Fractionation of the higher-boiling SHC fraction (e.g., in an SHC atmospheric distillation column) can then provide the SHC gas oil and SHC pitch as a liquid bottoms product, namely an SHC atmospheric column bottoms product, as well as one or more distilled fractions that make up all or a part of the SHC distillate (or SHC distillate yield). The feed to the SDA process, namely the combined SHC pitch/SHC gas oil stream, will therefore normally contain hydrocarbons with a range of boiling points characteristic of atmospheric column residues. For example, the liquid bottoms product of the SHC atmospheric distillation column may have an initial boiling point of at least about 343° C. (650° F.).

In other embodiments, it may be desired to remove a greater fraction, as a distillate product, from the higher-boiling SHC fraction of a higher pressure separator, as discussed above. One option is to perform a vacuum flash separation on this stream, prior to (upstream of) the SDA process and passing only the SHC vacuum flash bottoms product to SDA. This bottoms product of an SHC vacuum flash separator will therefore generally comprise an SHC gas oil having an increased initial boiling point, relative to the embodiment described above, in which an SHC atmospheric column is used to fractionate the higher-boiling SHC fraction. For example, using a vacuum flash separator, a representative SHC gas oil (in combination with SHC pitch), that is sent as a feed to SDA, has an initial boiling point, or distillation "front-end," temperature, in representative embodiments, of at least about 427° C. (800° F.) or at least about 454° C. (850° F.). In this case, the overhead vapor from the SHC vacuum flash separator will be a distillate product (e.g., containing hydrocarbons boiling in the gas oil range) in addition to the distillate product(s) recovered upstream, for example, in a high pressure separator vapor fraction.

The SHC distillate may therefore comprise one or more, separately recovered distillate products. These distillate products can include any hydrocarbon-containing fractions, for example the HPS vapor fraction, discussed above, obtained as a result of conversion in the SHC reactor or reaction zone. Other representative distillate products include one or more distilled fractions, such as naphtha and diesel products and their mixtures, from the SHC atmospheric distillation column. In some embodiments, heavier boiling hydrocarbons such as gas oil fractions may also be recovered as distillate products. According to representative embodiments, substantially all of the SHC effluent, except for a vapor fraction (e.g., comprising the hydrogen-rich gas stream) from a flash separator is fractionated in the SHC atmospheric distillation column. For example, the distilled fractions in this column may account for all or substantially all (e.g., at least about 90% by weight or even at least about 95% by weight) of the SHC distillate yield.

According to representative embodiments of the invention, the yield of SHC distillate (the combined amount of distillate products having a distillation end point in the ranges described herein), is generally at least 30% by weight (e.g., from about 30% to about 65% by weight), normally at least about 35% by weight (e.g., from about 35% to about 55% by weight), and often at least about 40% by weight (e.g., from about 40% to about 50% by weight), of the combined SHC effluent weight (e.g., the combined weight of the recovered SHC distillate products and the SHC gas oil/SHC pitch fed to SDA).

Depending on the desired end products, the SHC distillate product that is an HPS vapor fraction, as discussed above, may itself be fractionated to yield, for example, naphtha and diesel fuel having varying distillation end point temperatures. For example, a relatively light naphtha may be separated from the SHC distillate, having a distillation end point temperature from about 175° C. (347° F.) to about 193° C. (380° F.). According to other embodiments, a relatively heavy naphtha may be separated, having a distillation end point temperature from about 193° C. (380° F.) to about 204° C. (400° F.). The naphtha may be fractionated into one or more naphtha fractions, for example light naphtha, gasoline, and heavy naphtha, with representative distillation end points being in the ranges from about 138° C. (280° F.) to about 160° C. (320° F.), from about 168° C. (335° F.) to about 191° C. (37520 F.), and from about 193° C. (380° F.) to about 216° C. (420° F.), respectively. Distilled fractions obtained from the SHC atmospheric distillation column may similarly have distillation end points in any of these ranges.

The one or more distillate products that are components of the SHC distillate will normally contain quantities of organic nitrogen compounds and organic sulfur compounds, with quantities varying according to the particular separation/fractionation conditions used to recover these products. For example, the amount of total sulfur, substantially present in the form of organic sulfur compounds such as alkylbenzothiophenes, in any of the distillate products may generally be from about 0.1% to about 4% by weight, normally from about 0.2% to about 2.5% by weight, and often from about 0.5% to about 2% by weight. The amount of total nitrogen in the distillate product(s), substantially present in the form of organic nitrogen compounds such as non-basic aromatic compounds including carbazoles, may normally be from about 100 ppm to about 2% by weight, and often from about 100 ppm to about 750 ppm by weight. These products will also generally contain a significant fraction of polyaromatics such as 2-ring aromatic compounds (e.g., fused aromatic rings such as naphthalene and naphthalene derivatives) as well as multi-ring aromatic compounds. According to some representative embodiments, the combined amount of 2-ring aromatic compounds and multi-ring aromatic compounds may be at least about 50% by weight in any of the recovered distillate products, whereas the amount of mono-ring aromatic compounds (e.g., benzene and benzene derivatives such as alkylaromatic compounds) typically represents only at most about 20% by weight.

The heavy hydrocarbon feedstock to the SHC reactor or reaction zone, as discussed above, often comprises a vacuum column resid, in addition to the DAO product of SDA. Other representative components, as fresh hydrocarbon feeds, that may be included in the heavy hydrocarbon feedstock include gas oils such as straight-run gas oils (e.g., vacuum gas oil), recovered by fractional distillation of crude petroleum. Other gas oils produced in refineries include coker gas oil and visbreaker gas oil. In the case of a straight-run vacuum gas oil, the distillation end point is governed by the crude oil vacuum fractionation column and particularly the fractionation temperature cutoff between the vacuum gas oil and vacuum column bottoms split. Thus, refinery gas oil components suitable as fresh hydrocarbon feed components of the heavy hydrocarbon feedstock to the SHC reactor, such as straight-run fractions, often result from crude oil fractionation or distillation operations, while other gas oil components are obtained following one or more hydrocarbon conversion reactions. Whether or not these gas oils are present, the combined heavy hydrocarbon feedstock to the SHC reaction zone can be a mixture of hydrocarbons (i) boiling predominantly in a representative crude oil vacuum column residue range, for example above about 538° C. (1000° F.), and (ii) hydrocarbons boiling in a representative gas oil range, for example from about 343° C. (650° F.) to an end point of about 593° C. (1100° F.), with other representative distillation end points being about 566° C. (1050° F.), about 538° C. (1000° F.), and about 482° C. (900° F.). In this case, components (i) and (ii) of the heavy hydrocarbon feedstock are therefore representative of a crude oil vacuum column residue and the recycle DAO, respectively.

The SHC may be beneficially combined with hydrotreating, such that any of the recovered distillate products (e.g., a naphtha fraction and/or or a diesel fraction obtained from an SHC atmospheric distillation column) may be catalytically hydrotreated in a hydrotreating zone to reduce the content of total sulfur and/or total nitrogen. According to specific embodiments, for example, a hydrotreated naphtha fraction may be obtained having a sulfur content of less than about 30 ppm by weight, often less than about 10 ppm by weight, and in some cases even less than about 5 ppm by weight. A hydrotreated diesel fuel may be obtained having a sulfur content of less than about 50 ppm by weight, often less than about 20 ppm by weight, and in some cases even less than about 10 ppm by weight. Hydrotreating of the SHC distillate, or its distillate product components, to provide a hydrotreated distillate, may therefore provide low-sulfur products and even ultra low sulfur naphtha and diesel fractions in compliance with applicable tolerances.

In preferred embodiments, any distillate product or component of the SHC distillate (or the entire SHC distillate, for example recovered as a single stream) after hydrotreating (i.e., a hydrotreated distillate) has a sufficient API gravity for incorporation into a crude oil or synthetic crude oil obtained, for example, from tar sands. Representative API gravity values are greater than about 20° (e.g., from about 25° to about 40°) and greater than about 35° (e.g., from about 40° to about 55°). Particular sources of synthetic crude oil of increasing interest, and for which blending components are sought to improve their flow characteristics, are bitumen and oil sands. Bitumen refers to the low-quality hydrocarbonaceous material recovered from oil sand deposits, such as those found in the vast Athabasca region of Alberta, Canada, as well as in Venezuela and the United States. Bitumen and oil sands are recognized as a valuable sources of "semi-solid" petroleum or synthetic crude oil, which can be refined into many valuable end products including transportation fuels such as gasoline or even petrochemicals.

In other embodiments, integration of the SHC process with hydrotreating can involve, for example, passing an additional refinery distillate stream, such as a straight-run distillate, to the hydrotreating zone or reactor. Whether or not one or more additional streams are hydrotreated in combination with the distillate products from SHC, the hydrotreating is normally carried out in the presence of a fixed bed of hydrotreating catalyst and a combined recycle gas stream containing hydrogen. Typical hydrotreating conditions include a temperature from about 260° C. (500° F.) to about 426° C. (800° F.), a pressure from about 7.0 MPa (1000 psig) to about 21 MPa (3000 psig), and a liquid hourly space velocity (LHSV) from about 0.1 $hr^{-1}$ to about 10 $hr^{-1}$. As is understood in the art, the Liquid Hourly Space Velocity (LHSV, expressed in units of $hr^{-1}$) is the volumetric liquid flow rate over the catalyst bed divided by the bed volume and represents the equivalent number of catalyst bed volumes of liquid processed per hour. The LHSV is closely related to the inverse of the reactor residence time. Suitable hydrotreating catalysts comprise a metal selected from the group consisting of nickel, cobalt, tungsten, molybdenum, and mixtures thereof, on a refractory inorganic oxide support. Thus, integrated SHC/SDA processes may additionally be integrated with crude oil fractionation columns, such that a straight-run distillate from a crude oil atmospheric distillation column is hydrotreated together one or more SHC distillate products.

As discussed above, the SHC process is advantageously integrated with SDA wherein a DAO product from SDA is passed to the SHC reaction zone for upgrading, thereby beneficially solubilizing asphaltenes and suppressing coke formation in the SHC reactor. Additionally, the other major product of SDA, namely the SDA pitch, contains relatively concentrated amounts of asphaltenes and hydrogen-deficient compounds, which can be detrimental if recycled to the SHC reactor. The SDA pitch is normally removed as a byproduct of the integrated process, but one or more portions of the SDA pitch, for example the SHC catalyst, may be recovered (e.g., by filtration), and recycled to the SHC reactor.

Embodiments of the invention therefore involve the utilization of an SHC pitch, recovered from downstream separation and/or fractionation of the SHC effluent or a higher boiling fraction or cut of this effluent (e.g., a fraction having a higher initial boiling point), as an SDA process feed. A typical SHC pitch stream is recovered together with SHC gas oil as a liquid bottoms product of atmospheric distillation. An SHC pitch will normally comprise or consist essentially of hydrocarbons boiling at temperatures greater than about 482° C. (900° F.), usually greater than about 538° C. (1000° F.), and often greater than about 593° C. (1100° F.). Exemplary embodiments of the invention are therefore directed to integrated SHC/SDA processes that eliminate the conventional vacuum distillation column used to separate SHC gas oil from SHC pitch (i.e., the process is performed without a vacuum column fractionation of the SHC effluent or any SHC effluent fraction).

According to a particular embodiment, in which a higher-boiling high pressure separator (HPS) liquid fraction is recovered as a bottoms stream exiting an HPS, atmospheric fractionation of this HPS liquid fraction, or various portions thereof (e.g., after further separation of gases such as $H_2$, $H_2S$, and light $C_1$-$C_4$ hydrocarbons) may be performed to yield one or more distillate products (e.g., naphtha, diesel fuel, other distilled fractions, or mixtures thereof). As discussed above, the liquid bottoms product from this SHC atmospheric column is then passed to the SDA process to provide DAO, all or a portion of which is recycled to the SHC reactor, and SDA pitch. The DAO is effectively converted in the SHC reactor to upgraded products, for example higher-value distillates as blending stocks for transportation fuels.

The present invention therefore relates to overall refinery flowschemes or processes for upgrading crude oil in the manner discussed above, and especially such overall processes wherein a DAO obtained from an SDA process is part of the heavy hydrocarbon feedstock to an SHC process. Due to the conversion of DAO in the SHC reactor, SHC distillates are a major product of such overall, integrated SHC/SDA flowschemes. According to representative embodiments of the invention, the yields of distillate products, having representative boiling point ranges as described herein, from such integrated processes account for at least 60% of the overall process yields (e.g., from about 60% to about 95%), and often account for at least 75% of these yields (e.g., from about 75% to about 90%).

Further aspects of the invention relate to utilizing the SHC processes discussed above for making a synthetic crude oil or synthetic crude oil blending component. The processes involve passing a DAO derived from an SDA process to an SHC process, with optional integration of the process with a hydrotreater as discussed above. Depending on the fractionation conditions used for downstream processing of the SHC effluent, an SHC distillate, comprising one or more distillate products, may be obtained having hydrocarbons essentially all boiling in the distillate range or lower. In representative embodiments, less than about 20% by weight, and often less than about 10% by weight, of the total SHC distillate are hydrocarbons boiling at a temperature of greater than 343° C. (650° F.).

A representative process flowscheme illustrating a particular embodiment for carrying out the methods described above is depicted in FIG. 1. FIG. 1 is to be understood to present an illustration of the invention and/or principles involved. Details including pumps, compressors, instrumentation, heat exchange and heat-recovery circuits, and other items not essential to the understanding of the invention are not shown. As is readily apparent to one of skill in the art having knowledge of the present disclosure, methods according to various other embodiments of the invention will have configurations, components, and operating parameters determined, in part, by the specific feedstocks, products, and product quality specifications.

According to the embodiment illustrated in FIG. 1, a slurry hydrocracking (SHC) reactor or reaction zone 101 is integrated with solvent deasphalting (SDA) in a solvent extraction zone 104. The heavy hydrocarbon feedstock 1 to this SHC reaction zone 101 is a combination of vacuum column residue stream (or resid) stream 2 and deasphalted oil (DAO) 3 obtained from extraction in solvent extraction zone 104 of the SDA process. Vacuum column resid stream 2 is normally the bottoms product of a crude vacuum column or tower (not shown), typically containing hydrocarbons boiling above (i.e., having a cutpoint temperature) of about 566° C. (1050° F.). An upstream crude oil atmospheric column (not shown) generates atmospheric residue or a reduced crude stream, with a typical cutpoint temperature of about 343° C. (650° F.) that is fractionated in this crude vacuum column. Optionally, the heavy hydrocarbon feedstock 1 further includes a gas oil such as straight run vacuum gas oil (VGO) from this crude vacuum column, which, for example, contains hydrocarbons boiling in the range from about 343° C. (650° F.) to about 566° C. (1050° F.).

SHC reactor 101 is therefore utilized in an integrated manner to upgrade DAO 3 from SDA, which may be obtained as the bottoms product of a solvent recovery column 105, for overhead separation of solvent (e.g., butane, pentane, or higher molecular weight paraffins) from DAO 3. The overhead product of solvent recovery column 105 is recycle solvent 5 that is combined with fresh make-up solvent 6 to provide combined recycle solvent 4. Combined recycle solvent 4 is fed to a lower section of solvent extraction zone 104, as shown in FIG. 1. Also introduced to an upper section of this solvent extraction zone 104 is SHC gas oil/SHC pitch 7 of SHC atmospheric distillation column 103, which contacts recycle solvent 4 in solvent extraction zone 4 in a counter-current manner. In an alternative embodiment (not shown), recycle solvent 4 may be combined or mixed with SHC atmospheric column bottoms product 7, prior to entry to solvent extraction zone feed 10. A drag stream (not shown) may be removed from the recycle solvent loop to limit the accumulation of impurities.

As discussed above, DAO 3 is effectively upgraded in SHC reactor 101 and, in addition, can beneficially solubilize asphaltenes in the heavy hydrocarbon feedstock 1, thereby suppressing coke formation in the SHC reactor 101 and fouling of SHC process equipment. The total SHC effluent 8 from SHC reactor 101 is subjected to downstream separation/fractionation operations to recover upgraded products and combined SHC gas oil/SHC pitch 7 as a liquid bottoms product of SHC atmospheric distillation column 103. Separation/fractionation of the total SHC effluent 8 in a downstream product recovery section generally also involves removing a hydrogen-rich gas stream (not shown) for recycle to the SHC reactor. According to the embodiment illustrated in FIG. 1, total SHC effluent 8 is separated using hot high pressure separator (HPS) 102 to recover vapor fraction 9A from this flash separation, which may be, or may contain, one of a plurality (e.g., two or more) of distillate products, generally boiling in a range above that of naphtha.

A higher-boiling HPS liquid fraction 11 recovered from SHC effluent 8 and in particular from the bottom of HPS 102 is then fractionated in SHC atmospheric distillation column 103, which may yield one or more distilled SHC fractions 9B, 9C, and 9D, as additional distillate products that contribute to the overall yield of SHC distillate. For example, fraction 9B and 9C may be recovered as light and heavy SHC naphtha products, respectively, while fraction 9D may be an SHC diesel product. As discussed above, it may be possible, according to some embodiments, to eliminate SHC atmospheric distillation column 103 in favor of passing higher-boiling HPS liquid fraction 11 directly to solvent extraction zone 104. Alternatively, HPS liquid fraction 11 may be subjected to a single-stage vacuum separation (vacuum flash) or multi-stage fractionation under vacuum pressure to remove lower boiling components (e.g., light gas oil boiling below about 427° C. (800° F.) or below about 454° C. (850° F.)), thereby allowing these components to be recovered as additional distillate products, such as gas oil product 9E. According to this embodiment, the content of gas oil in the liquid bottoms product 7 introduced to solvent extraction zone 104 is reduced.

Solvent phase 12, containing solvent and extracted DAO, exits an upper section of counter-current extraction zone 104 and is sent to solvent recovery column 105 to provide DAO stream 3 and recycle solvent 5. The other major product of SDA is SDA pitch 10 that exits a lower section of extraction zone 104. SDA pitch may be processed (i) for recovery and/or recycle of all or a portion of the particulate SHC catalyst contained in this stream, and/or (ii) using conventional steps for processing refinery pitch. The overall integrated process illustrated in FIG. 1 therefore produces essentially the net products of SDA pitch 10 and distillate products 9A-9D from SHC. Any one, or any combination of distillate products 9A-9D may be treated in a distillate hydrotreating process, for example as incremental feed streams to an existing hydrotreater processing a straight-run distillate. In this manner, a hydrotreated distillate is obtained as a product of the overall process having reduced nitrogen compound and sulfur compound impurities and/or an API gravity as discussed above that may be utilized as a blending component for synthetic crude oil.

As is apparent from this description, overall aspects of the invention are directed to the integration of slurry hydrocracking (SHC) and solvent deasphalting (SDA) to optimize refinery operations. In view of the present disclosure, it will be seen that several advantages may be achieved and other advantageous results may be obtained. Those having skill in the art will recognize the applicability of the methods disclosed herein to any of a number of integrated SHC processes. Those having skill in the art, with the knowledge gained from the present disclosure, will recognize that various changes could be made in the above processes without departing from the scope of the present disclosure.

The invention claimed is:

1. An integrated process for preparing a slurry hydrocracking (SHC) distillate, the process comprising:

(a) subjecting an SHC gas oil to solvent deasphalting (SDA) to obtain a deasphalted oil (DAO) and an SDA pitch;

(b) passing a heavy hydrocarbon feedstock comprising at least a portion of said DAO through an SHC reaction zone in the presence of hydrogen to provide an SHC effluent; and (c) recovering, apart from said SDA, said SHC distillate and said SHC gas oil from said SHC effluent, wherein said SHC gas oil is recovered in combination with an SHC pitch as an SHC atmospheric column bottoms product of an SHC atmospheric distillation column, and wherein said SHC gas oil and said SHC pitch are subjected to SDA in step (a).

2. The process of claim 1, wherein said heavy hydrocarbon feedstock comprises all of said DAO obtained from SDA in step (a).

3. The process of claim 1, wherein, in step (a), said SDA comprises contacting said SHC gas oil with a solvent that extracts said DAO to separate it from said SDA pitch.

4. The process of claim 3, wherein said solvent comprises butane or pentane.

5. The process of claim 1, wherein the SHC reaction zone provides from about 80% to about 90% per-pass conversion of the heavy hydrocarbon feedstock to hydrocarbons boiling at a temperature of less than 566° C. (1050° F.).

6. The process of claim 1, wherein hydrogen consumption in said SHC reaction zone is less than about 356 $m^3$ of hydrogen per $m^3$ of said heavy hydrocarbon feedstock (2000 SCFB).

7. The process of claim 1, wherein the heavy hydrocarbon feedstock is present as a slurry, in combination with a solid particulate, in said SHC reaction zone.

8. The process of claim 7, wherein said solid particulate comprises a compound of a metal of Group IVB, Group VB, Group VIB, Group VIIB, or Group VIII.

9. The process of claim 1, wherein said heavy hydrocarbon feedstock further comprises a vacuum column residue.

10. The process of claim 1, wherein said SHC distillate is recovered as a lower boiling component of said SHC effluent.

11. The process of claim 1, wherein said SHC gas oil has an initial boiling point of at least about 343° C. (650° F.).

12. The process of claim 1, wherein said SHC gas oil, said SHC pitch, and said SHC distillate, are all recovered in the absence of a vacuum distillation column.

13. The process of claim 1, wherein said SHC distillate is recovered in one or more distillate products comprising (i) a vapor fraction from flash separation of said SHC effluent in an SHC high pressure separator, (ii) one or more distilled fractions from said atmospheric distillation column, or (iii) both (i) and (ii).

14. The process of claim 13, wherein said one or more distilled fractions from said atmospheric distillation column are selected from the group consisting of a naphtha product, a diesel product, or a mixture thereof.

15. The process of claim 13, further comprising hydrotreating a distillate feedstock comprising said one or more distillate products in a hydrotreating zone to obtain a hydrotreated distillate.

16. The process of claim 1, wherein said SHC gas oil is recovered in combination with an SHC pitch as an SHC vacuum flash bottoms product of an SHC vacuum flash separator, and wherein said SHC gas oil and said SHC pitch are subjected to SDA in step (a).

17. The process of claim 16, wherein said SHC gas oil has an initial boiling point of at least about 427° C. (800° F.).

18. A method for making a distillate hydrocarbon component by integrating slurry hydrocracking (SHC) and solvent deasphalting (SDA), the method comprising:

(a) passing a slurry comprising a crude oil vacuum column residue, a deasphalted oil (DAO) obtained from SDA, and a solid particulate through an SHC reaction zone in the presence of hydrogen to provide an SHC effluent, (b) recovering said SHC distillate and a combination of an SHC gas oil and an SHC pitch from said SHC effluent, (c) subjecting said combination of said SHC gas oil and said SHC pitch to SDA to provide an SDA pitch and said DAO, and (d) recycling said DAO to said SHC reaction zone.

19. The method of claim 18, wherein the SHC distillate comprises less than about 20% by weight of hydrocarbons boiling at a temperature of greater than 343° C. (650° F.).

* * * * *